US006909062B2

(12) United States Patent
Narusawa et al.

(10) Patent No.: US 6,909,062 B2
(45) Date of Patent: Jun. 21, 2005

(54) KEY-SWITCH DEVICE CORRESPONDING TO MINIATURIZED NOTEBOOK-SIZE PERSONAL COMPUTER WITH REDUCED-THICKNESS

(75) Inventors: Tsuyoshi Narusawa, Fukushima-ken (JP); Kazuhiro Yakoyama, Fukushima-ken (JP); Takayuki Ito, Fukushima-ken (JP); Sadayuki Yaginuma, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/832,551

(22) Filed: Apr. 27, 2004

(65) Prior Publication Data

US 2004/0195081 A1 Oct. 7, 2004

Related U.S. Application Data

(63) Continuation of application No. 10/122,023, filed on Apr. 11, 2002, now Pat. No. 6,777,634.

(30) Foreign Application Priority Data

Apr. 12, 2001 (JP) ..... 2001-114173
Jun. 14, 2001 (JP) ..... 2001-180740

(51) Int. Cl.[7] ..... H01H 3/12
(52) U.S. Cl. ..... 200/344
(58) Field of Search ..... 200/344

(56) References Cited

U.S. PATENT DOCUMENTS 5,278,371 A 1/1994 Watanabe et al.
5,847,337 A 12/1998 Chen ..... 200/344
6,107,584 A 8/2000 Yoneyama ..... 200/344

*Primary Examiner*—Renee Luebke
(74) *Attorney, Agent, or Firm*—Brinks Hofer Gilson & Lione

(57) ABSTRACT

A key-switch device includes a key-top having retainers formed on the back surface of the key-top, first and second levers disposed under the key-top, each lever including a base-end part and a pair of arms opposing each other and extending from both ends of the base-end part, the first and second levers being connected together rotatably about the substantial center of the pair of arms as an intersecting point, a lever-holding plate capable of retaining each lower end of the first and second levers, and an actuator member attached to and spanned between both the base-end parts of the first and second levers. Further, the actuator member has a concave slide-retainer-receiving part with the open top, and the base-end part of the second lever is slidably retained in the slide-retainer-receiving part.

3 Claims, 20 Drawing Sheets

KEY-SWITCH DEVICE CORRESPONDING TO MINIATURIZED NOTEBOOK-SIZE PERSONAL COMPUTER WITH REDUCED-THICKNESS

This application is a continuation of application Ser. No. 10/122,023, filed on Apr. 4, 2002 and now U.S. Pat. No. 6,777,634.

BACKGROUND OF THE INVENTION

1. Field of the Invention

The present invention relates to a key-switch device for use as various input devices of personal computers and word processors, etc., and in particular it relates to a key-switch device corresponding to miniaturization and reduction in thickness of notebook-size personal computers.

2. Description of the Related Art

Along with demands for reduction in size and miniaturization of the entire device, various key-switch devices have been proposed, in which a key-top is attached at the upper end of a pair of lever members crosswise linked together so as to change the angle between the pair of lever members link-crossing each other by moving the key-top up-and-down.

The type of conventional key-switch device will be described below with reference to FIGS. 26 to 29.

As shown in FIG. 26, the conventional key-switch device principally comprises a key-top 101, a holder member 130 disposed beneath the key-top 101, a guide-supporting member 106 for guiding and supporting the key-top 101 between an elevated position separated from the holder member 130 and a lowered position coming close to the holder member 130, and a rubber spring 131 arranged between the key-top 101 and the holder-member 130.

The key-top 101, as shown in FIGS. 26 and 27, is provided with a character (not shown) formed on the top surface thereof by printing, and a pair of rotational retainers 101*a* and a pair of slide-retainers 101*b*, which are respectively arranged on the back surface. The pair of rotational retainers 101*a* are provided with retaining slots 104 respectively formed thereon while the pair of slide-retainers 101*b* are provided with retaining slots 105 respectively formed thereon.

The guide-supporting member 106 is formed of two resin-made lever members 107 and 108. As shown in FIG. 28, one U-shaped lever member 107 comprises a pair of arms 107*a* and a base-end part 107*b* connecting one end of one arm 107*a* to that of the other arm 107*a*. The other end of each arm 107*a* is provided with a retainer pin 107*d* protruded therefrom, and the central part of each arm 107*a* is provided with a shaft 107*c* formed inside thereof to protrude therefrom.

The other lever member 108, as shown in FIG. 29, comprises a pair of arms 108*a*, a base-end part 108*b* connecting one end of one arm 108*a* to that of the other arm 108*a*, retainer pins 108*d* formed at the other end of each arm 108*a*, and a depressing shaft 110 for connecting inside central parts of the arms 108*a* together. The central part of each arm 108*a* is provided with a hole 108*c* formed outside thereof, and at one end of each arm 108*a*, a retainer pin 108*e* is formed to protrude from outside.

The holder member 130, as shown in FIGS. 26 and 27, is formed of a metallic flat plate and comprises a pair of fitting parts 126 and a pair of retainers 127, which are cut-up from the surface. In addition, on the top surface of the holder member 130, a metallic frame 132 having plural openings 132*a* is arranged, and the fitting parts 126 and the retainers 127 protrude upwardly from the openings 132*a* of the frame 132.

The base-end part 107*b* of the one lever member 107 is rotatably retained in the retaining slots 104 of the rotational retainers 101*a* while the retainer pins 107*d* are slidably retained to the fitting parts 126 of the holder member 130.

Also, the retainer pins 108*d* of the other lever member 108 are slidably retained in the retaining slots 105 of the slide-retainers 101*b* of the key-top 101, while the retainer pins 108*e* are rotatably retained in the retainers 127 of the holder member 130.

Next, assembling of the key-switch device will be described: a conductive film sheet (not shown) is placed on the holder member 130. In addition, the sheet has the rubber spring 131 bonded thereon in advance. From the sheet, the fitting parts 126 of the holder member 130 and the retainers 127 protrude upwardly through the openings 132*a* of the frame 132.

Next, the one lever member 107 and the other lever member 108 are crosswise combined together so that each shaft 107*c* is rotatably inserted into the hole 108*c* so as to complete the guide-supporting member 106. Then, while the retainer pins 108*e* of the lever member 108 are press-fitted into holes of the retainers 127 of the holder member 130, the retainer pins 107*d* are slidably retained in the fitting parts 126. At this time, the depressing shaft 110 is positioned on the rubber spring 131.

Next, the key-top 101 is prepared so as to elastically abut the retainer pins 108*d* of the lever member 108 by depressing them from an obliquely upper direction (upper right part of FIG. 26), and the retainer pins 108*d* of the lever member 108 are inserted into the retaining slots 105 of the key-top 101 by trial and error.

Furthermore, the key-top 101 is urged to an upper part (the base-end part 107*b* and the retainer pins 108*d*) of the lever members 107 and 108 from the upper part so as to snap the retaining slots 104 of the key-top 101 into the base-end part 107*b* of the lever member 107.

In such a manner, the key-switch device is completed.

Next, operation of the key-switch device will be described: referring to FIG. 26, when pushing down the key-top 101, the base-end part 107*b* of the one lever member 107 rotates within the retaining slots 104 of the rotational retainers 101*a* while the retainer pins 108*d* of the other lever member 108 slides within the retaining slots 105 of the slide-retainers 101*b* horizontally (the lateral direction in FIG. 26). Simultaneously, the base-end part 108*b* of the lever member 108 rotates within retaining holes of the retainers 127 of the holder member 130 while the retainer pins 107*d* of the lever member 107 slides within the fitting parts 126 for slidably retaining the pin horizontally (the lateral direction in FIG. 26).

As a result, a bearing A for mutually journaling the lever members 107 and 108 on bearings moves downwardly while the depressing shaft 110 pushes the rubber spring 131 down gradually so as to be buckled. Thereby, a movable contact (not shown) within the rubber spring 131 establishes a short circuit in a fixed-contact pattern (not shown) on the holder member 130 so as to perform a predetermined switching operation.

When the pushing-down of the key-top 101 is canceled, the bearing A of both the lever members 107 and 108 is pushed up due to an elastic restoring force of the rubber spring 131 so as to perform the reverse operation (switching-off operation) to that mentioned above, resulting in returning the key-top 101 to the original position.

As mentioned above, various different characters or symbols may be printed on the key-tops 101 attached to the lever members 107 and 108.

A number of problems exist with the conventional key-top thus described. For example, after the key-switch device is assembled in advance, it may need to be changed to that of a different kind according to demand during assembling or after assembling. When removing the key-top 101 from the lever members 107 and 108, the key-top 101 has to be changed while maintaining the intersecting angle between the lever members 107 and 108. This is an extremely complicated operation unless a specially designed jig is used.

Another problem occurs when assembling the key-switch device: first, after assembling the guide-supporting member 106, in which the lever members 107 and 108 are crossed with each other, both the retainer pins 108*e* and 108*e* of the lever member 108 are press-fitted into the retainers 127 of the holder member 130.

Then, the retainer pins 107*d* and 107*d* of the one lever member 107 are inserted into both the fitting parts 126 and 126 so as to assemble the lever members 107 and 108 into the holder member 130. However, since the slender resin lever member 107 is liable to deflect, the retainer pins 107*d* and 107*d* sliding on the surface of the holder member 130 may simply come off the fitting parts 126 during the assembling.

In addition, also when operating as the key-switch device, the retainer pins 107*d* of the lever member 107 are slidably retained in the fitting parts 126; however, since each retainer pin 107*d* simply extends in the longitudinal direction, it may come off the fitting part 126 when sliding.

The rotational retainers 101*a* of the key-top 101 are snapped into the base-end part 107*b* of the lever member 107 via the retaining slots 104; however, since the lower snapping side of the rotational retainer 101*a* is open, there is a problem that the key-top 101 may simply come off the lever member 107 when an external force pushing up the key-top 101 is applied.

When the key-top 101 is assembled into the lever members 107 and 108, the key-top 101 is assembled in a state that the retaining slots 104 and the retaining slots 105 formed on the back side of the key-top 101 are downward oriented so that they cannot be visually confirmed, resulting in the complicated assembling operation.

Also, when the base-end part 108*b* of the lever member 108 is inserted and assembled into the retainers 127 of the holder member 130, there is a problem that the base-end part 108*b* cannot be smoothly inserted by catching on the sliding contact part of the retainers 127 into the base-end part 108*b* of the lever member 108 on the top surface of the holder member 130.

SUMMARY OF THE INVENTION

One object of the present invention is to provide a key-switch device, in which assembling operation is simplified when a key-top is attached to lever members crosswise intersecting each other.

In order to solve at least one of the problems described above, in accordance with a first aspect of the present invention, a key-switch device comprises a key-top having retainers formed on the back surface of the key-top, first and second levers disposed under the key-top, each lever including a base-end part and a pair of arms opposing each other and extending from both ends of the base-end part, the first and second levers being connected together rotatably about the substantial center of the pair of arms as an intersecting point, a lever-holding plate, which can retain each lower end of the first and second levers, and an actuator member attached to and spanned between both the base-end parts of the first and second levers, wherein the actuator member has a concave slide-retainer-receiving part with the open top, and wherein the base-end part of the second lever is slidably retained in the slide-retainer-receiving part.

Preferably, the base-end part of the first lever comprises a support-receiving part formed in the center of the base-end part for retaining one end of the actuator member, both ends of the support-receiving part being provided with retainer-receiving parts formed for retaining the retainers of the key-top, and wherein the retainers of the key-top and the retainer-receiving parts of the first lever are opposed in order to be retained together to have a section shaped like two-commas.

Preferably, the retainers of the key-top comprise a pair of first retainers and a pair of second retainers, the pairs of first and second retainers being formed on the back surface of the key-top so as to protrude therefrom, wherein the back surface of the key-top is provided with a pair of first ribs formed to protrude from the back surface more distal to a center of a lateral side of the key-top than the second retainers, which oppose each other, and a second rib extending in parallel with the first ribs in the vicinity of the first retainers any without extending to a position between the first retainers, and wherein the key-top is inserted into and mounted on the first lever and the actuator member by respectively guiding the pair of arms of the first lever and the other end of the actuator member with the first ribs and the second rib.

Preferably, the base-end part of the first lever is rotatably journaled on bearings by one end of the actuator member, and the lower corner of the other end of the actuator member is obliquely cut with respect to a lower surface of the actuator member.

In accordance with a second aspect of the present invention, a key-switch device comprises first and second levers rotatably connected to each other about an intersecting point, a key-top supported by the first and second levers so as to be movable up and down, a switch member being switchably operable in accordance with the up-and-down movement of the key-top, and a lever-holding plate having a lower-slide retainer for slidably retaining the lower end of the first lever and a retainer unit for rotatably journaling the lower end of the second lever on bearings, and wherein the lower end of the first lever is provided with a detachment-preventing part formed for preventing the lower end of the first lever from coming off (inadvertently detaching from) the lower-slide retainer.

Preferably, the detachment-preventing part is an L-shaped retainer pin protruding from the lower end of the first lever and retained in the lower-slide retainer.

In accordance with a third aspect of the present invention, a key-switch device comprises first and second levers rotatably connected to each other about an intersecting point, a key-top supported by the first and second levers so as to be movable up and down, a switch member being switchably operable in accordance with the up-and-down movement of the key-top, and a lever-holding plate having retainers for respectively retaining lower ends of the first and second levers, wherein the respective first and second levers are provided with a base-end part and a pair of arms formed so as to extend from both ends of the base-end part and to oppose each other, the base-end part and the pair of arms being formed for guiding the up-and-down movement of the key-top, wherein the retainers of the lever-holding plate are classified into a lower-slide retainer for slidably retaining the lower end of the first lever and a retainer for rotatably journaling the lower end of the second lever on bearings, and wherein an end face of the first lever at the lower end, the end face sliding on the top surface of the lever-holding plate, is obliquely cut so as to have an acute angle relative to the extending direction of each arm.

In accordance with a fourth aspect of the present invention, a key-switch device comprises a key-top having a plurality of retainers formed on the back surface of the key-top, first and second levers disposed under the key-top, each lever including a base-end part and a pair of arms opposing each other and extending from both ends of the base-end part, the pairs of the arms being arranged movably with each other, a lever-holding plate, which can retain each of lower ends of the first and second levers, a connection member attached to and spanned between both of the base-end parts of the first and second levers, and a sheet switch arranged on the bottom surface of the lever-holding plate, wherein both ends of the connection member are provided with engaging parts formed for retaining to the retainers of the key-top, and the lever-holding plate is made of a metallic flat plate having substantially the same area as that of the key top.

In accordance with a fifth aspect of the present invention, a key-switch device comprises first and second levers connected to each other rotatably about an intersecting point, a key-top supported by the first and second levers so as to be movable up and down, a switch member being switchably operable in accordance with the up-and-down movement of the key-top, and a lever-holding plate for respectively retaining lower ends of the first and second levers, wherein the lever-holding plate is provided with a lower-slide retainer for slidably retaining the lower end of the first lever and a retainer unit for rotatably journaling the lower end of the second lever on bearings.

Preferably, part of the retaining unit is open and the retaining unit comprises a lower-rotational retainer for positioning the lower end of the second lever and a detachment-preventing retainer for preventing the lower end of the second lever from becoming detached.

Preferably, the detachment-preventing retainer is a projection protruding from the lever-holding plate.

Preferably, the second lever comprises a pair of arms arranged in parallel with each other, a connection part for connecting one end of one arm to that of the other arm of the pair of arms, and a pair of lower-rotational-retaining projections formed to extend from each of the arms, in which the connection part is formed, and wherein the respective lower-rotational-retaining projections are retained in the lower-rotational retainer.

Preferably, the projection is provided with a fractured plane formed by projecting part of the lever-holding plate, and the connection part abuts the fractured plane.

Preferably, a plurality of the projections protrude from the lever-holding plate to form the detachment-preventing retainer and are disposed in the vicinity of the lower-rotational retainer such that the connection part is clampable by the lower-rotational retainer and the projections forming the detachment-preventing retainer.

Since the key-switch device according to the present invention is configured in the manner described in the first aspect of the present invention, the key-top can be simply mounted in a state that a predetermined intersecting angle between the first and second levers is maintained due to the actuator member.

Since the key-switch device is configured in the manner described in the second aspect of the present invention, even when the first lever, which slides laterally when pressing the key-top in the vertical direction, deflects due to defects or irregularities in the resin or changes caused by the passage of time, predetermined operation can be securely performed without detachment.

Since the key-switch device is configured in the manner described in the third aspect of the present invention, the first lever can be smoothly assembled while sliding it in contact on the top surface of the lever holding plate.

BRIEF DESCRIPTION OF THE DRAWINGS

FIG. 23A is a schematic representation for illustrating a state before the link member is assembled into the lever holding plate; FIG. 23B is a schematic representation for illustrating a state that the link member is placed on the lever holding plate; and FIG. 23C is a schematic representation for illustrating a state that the link member is assembled into the lever holding plate;

DESCRIPTION OF THE PREFERRED EMBODIMENTS

A key-switch device according to an embodiment of the present invention will be described with reference to FIGS. 1 to 25.

Figure 1:
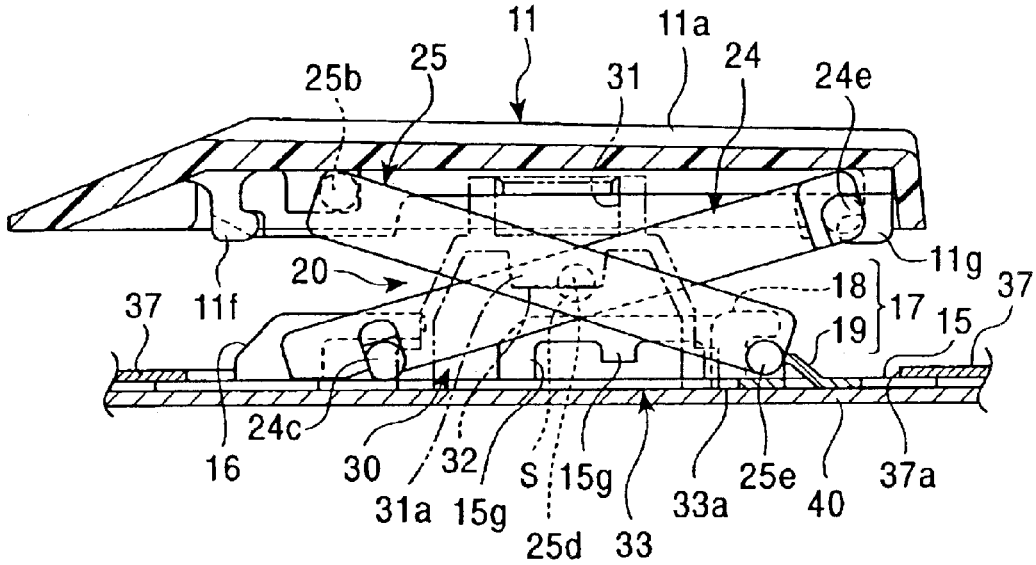
FIG. 1 is a sectional view of a key-switch device according to an embodiment of the present invention.
Figure 2:
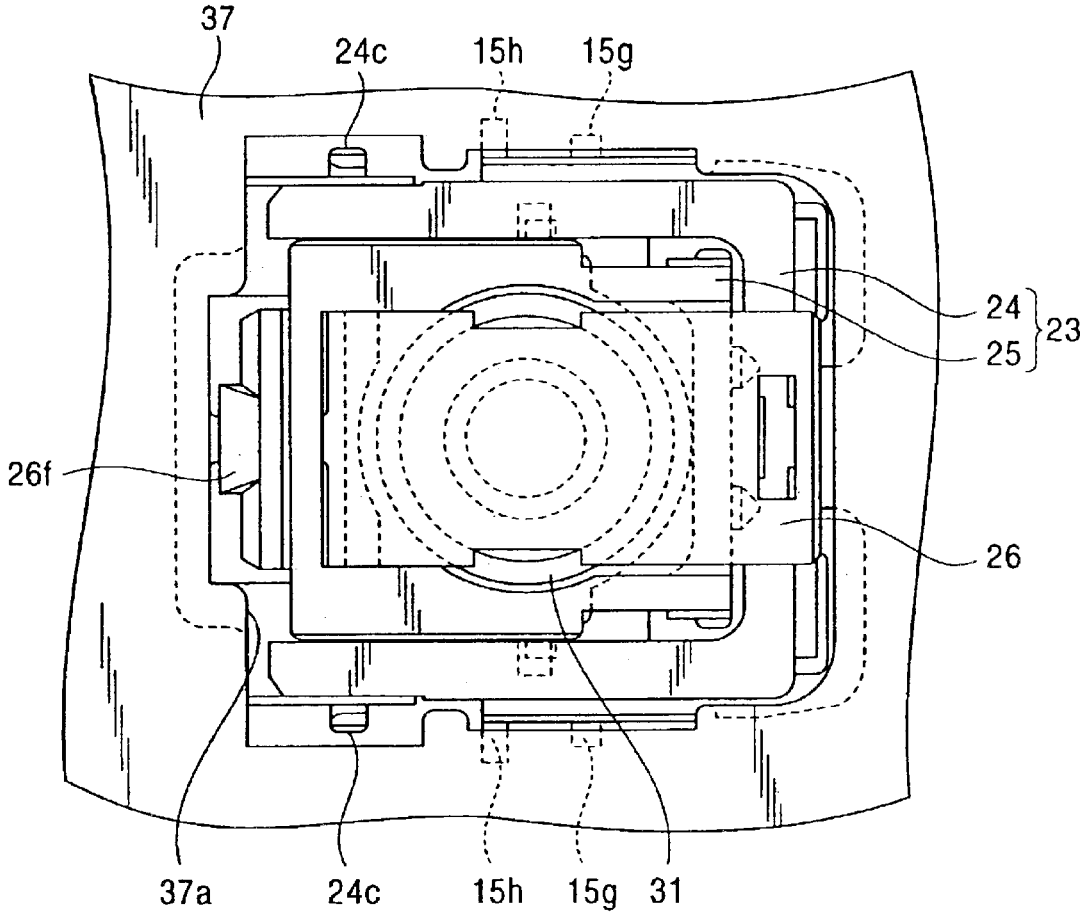
FIG. 2 is a plan view of the key-switch device according to the embodiment of the present invention, in which a key-top is omitted.

The key-switch device, as shown in FIG. 1, principally comprises a key-top 11 made of a resin, a lever-holding plate 15 disposed beneath the key-top 11, a link member 20 for guiding and supporting the key-top 11 between an elevated position of the key-top separated from the lever-holding plate 15 and a lowered position in which the key-top is disposed closer to the lever-holding plate 15 than when in the elevated position, and a switch member 30 arranged between the link member 20 and the lever-holding plate 15.

Figure 3:
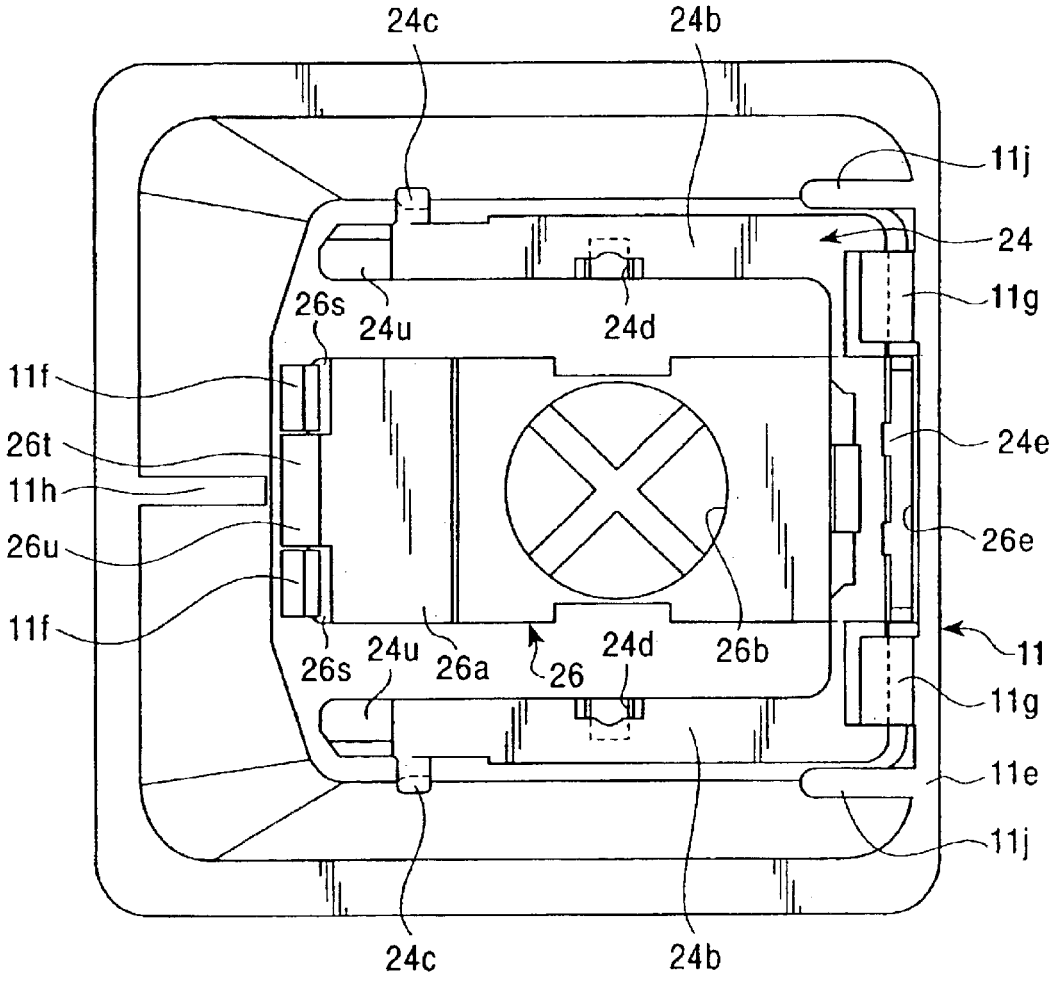
FIG. 3 is a partial plan view of the key-switch device according to the embodiment of the present invention viewed from the back-face side of a key-top.
Figure 4:
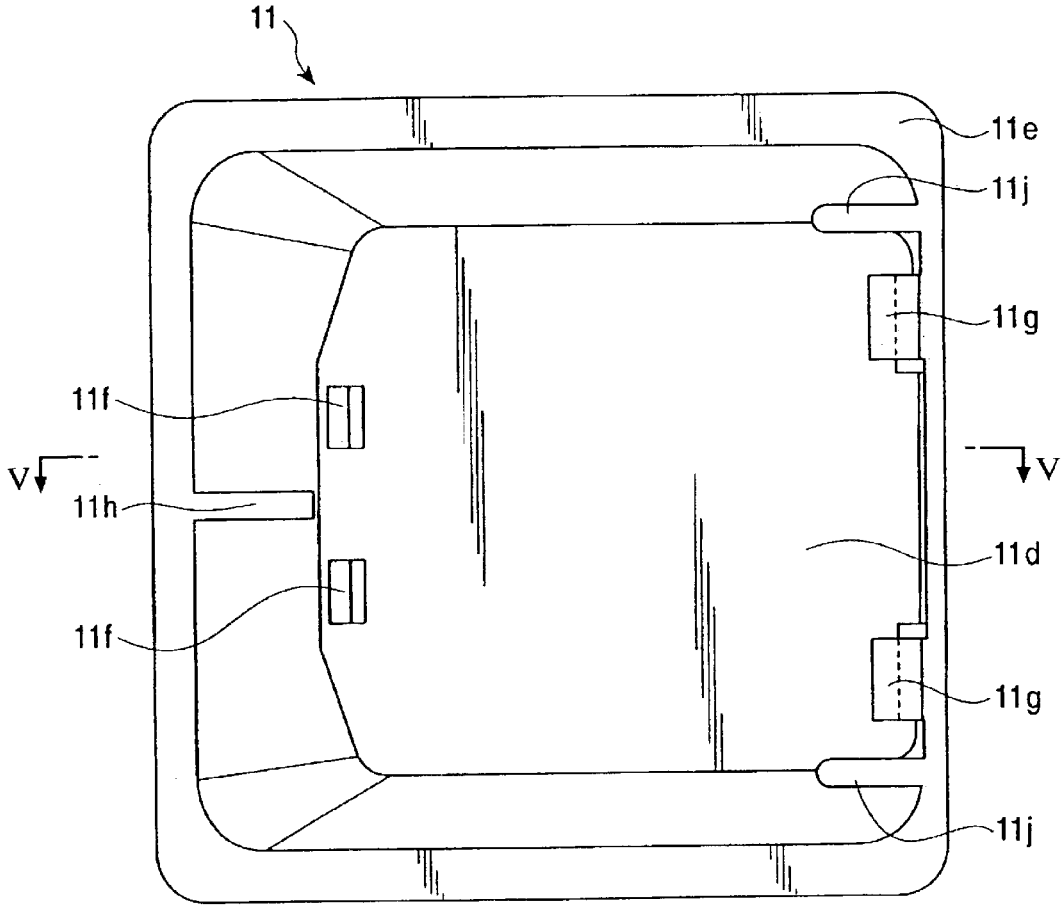
FIG. 4 is a back view of the key-top in the key-switch device according to the embodiment of the present invention.
Figure 5:
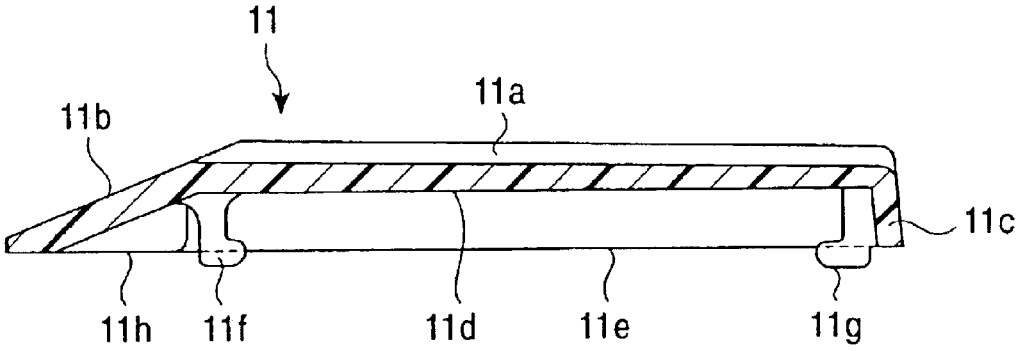
FIG. 5 is a sectional view of the key-top shown in FIG. 4.

The key-top 11 has a substantially rectangular external-shape, as shown in FIGS. 3 to 5. The key-top 11 comprises an operating surface 11*a* (see FIG. 5) with a character (not shown) such as an alphabet letter printed on the top surface thereof, an inclined surface 11*b* slantingly formed in the front (the left side in FIG. 5), a rear face 11*c* formed substantially at a right angle in the rear, a back surface 11*d* formed underneath the operating surface 11*a* substantially in parallel with the operating surface 11*a*, and an external-peripheral-fringe surface 11*e* formed on the external-peripheral fringe in the side of the back surface 11*d*.

The back and front sides (both the lateral sides in FIG. 4) of the back surface 11*d* are provided with a pair of first hook-like retainers 11*f* arranged to oppose each other and to be spaced by a predetermined distance therebetween and a pair of hook-like second retainers (retainers) 11*g* arranged to oppose each other and to be spaced by a distance larger than that of the first retainers 11*f*, both the first and second retainers 11*f* and 11*g* being arranged integrally with the back surface 11*d* so as to protrude downwardly.

The back surface 11*d* of the key-top 11 is provided with a pair of first ribs 11*j* formed to protrude from the back surface 11*d* in the vicinity of the exterior of the second retainers 11*g* (which oppose each other) and a second rib 11*h*. The second rib 11*h* extends in parallel with the first ribs 11*j* in the vicinity of the first retainers 11*f*, but does not extend to a position between the first retainers 11*f*. Both the first and second ribs 11*j* and 11*h* are arranged integrally with the back surface 11*d* so as to be flush with the external-peripheral-fringe surface 11*e*.

Figure 21A:
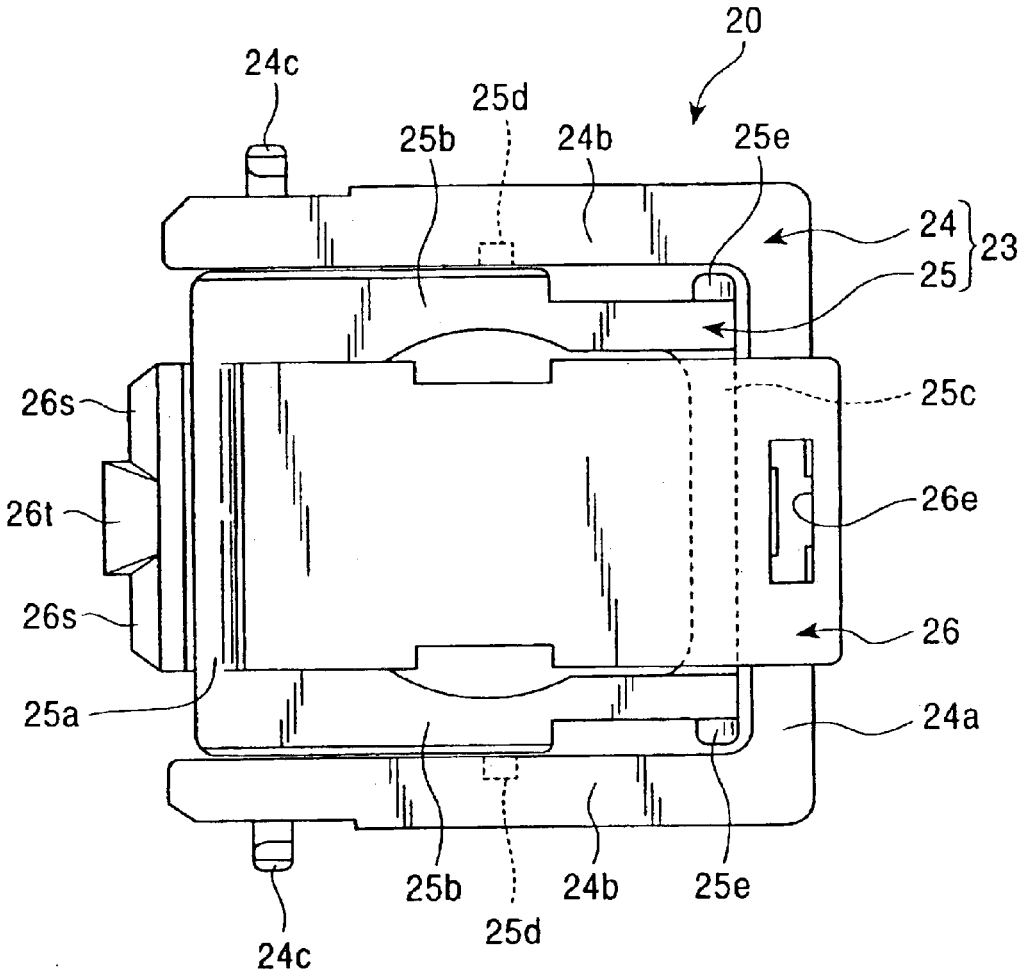
FIG. 21A is a partial plan view for illustrating assembling of a link member in the key-switch device according to the embodiment of the present invention.
Figure 21B:
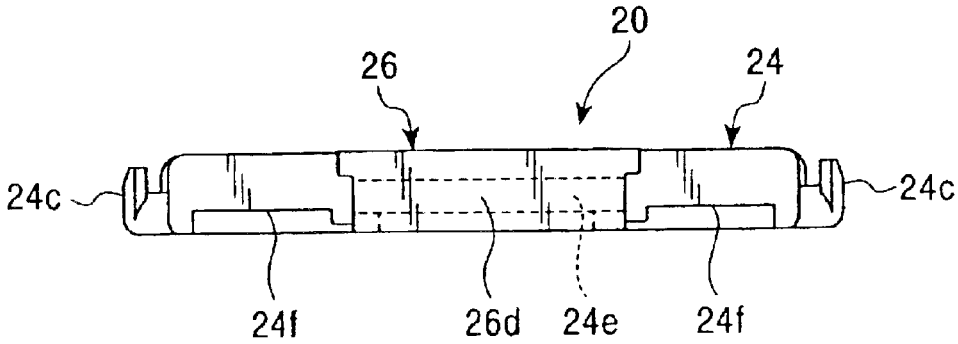
FIG. 21B is a rear view of the link member.

The link member 20, as shown in FIGS. 1, 21A, and 21B, comprises a pair of lever members (a first lever 24 and second lever 25) 23 and one actuator member 26.

The first lever (outside lever) 24 made of a resin, as shown in FIGS. 9 to 18, comprises a base-end part 24*a* and a pair of arms 24*b* integrally arranged to extend from both ends of the base-end part 24*a* and to oppose each other, the base-end part 24*a* and the arms 24*b* being arranged to be a substantially U-shape.

The end (the other end) of each arm 24*b* is a free end and is provided with a pair of retaining pins (detachment preventing parts) 24*c* formed to outwardly protrude.

Figure 11:
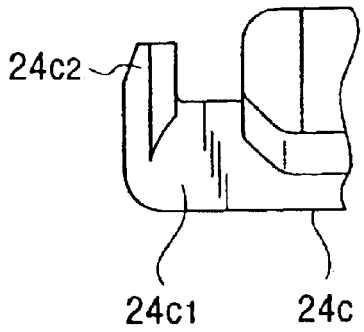
FIG. 11 is a partially enlarged view of the outside lever shown in FIG. 10.
Figure 12:
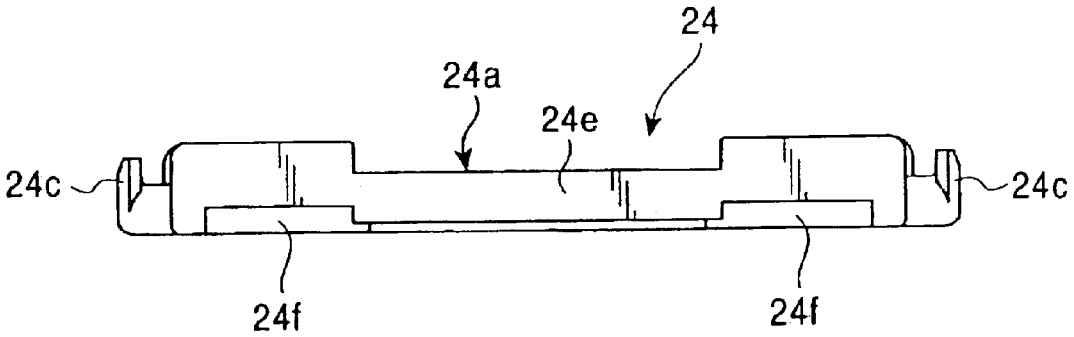
FIG. 12 is a rear view of the outside lever shown in FIG. 9.

More specifically, the retaining pin 24*c* comprises a sliding contact part 24*c*1 formed on the external wall of the arm 24*b* in the end side to extend in parallel with the longitudinal direction of the base-end part 24*a* and an end part 24*c*2 bent upwardly from the end of the sliding contact part 24*c*1 at a substantially right angle (see FIG. 11).

Figure 13:
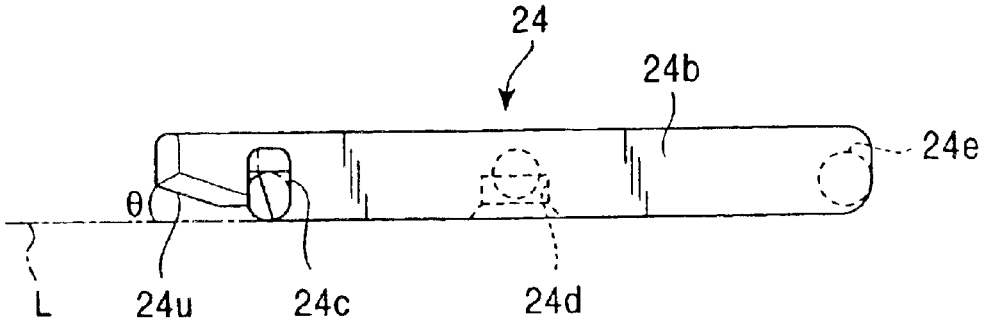
FIG. 13 is a side view of the outside lever shown in FIG. 9.
Figure 14:
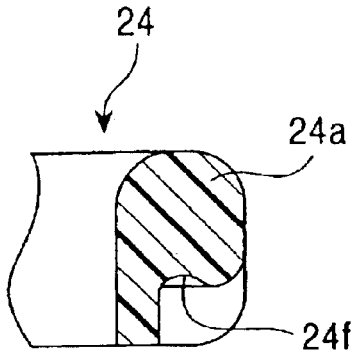
FIG. 14 is a sectional view of the outside lever shown in FIG. 9 at the line 14—14.
Figure 15:
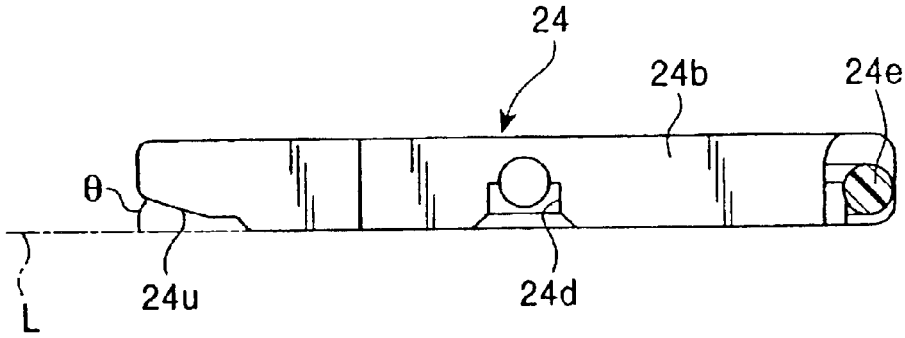
FIG. 15 is a drawing of the outside lever shown in FIG. 9 and viewed in the arrow direction at the line 15—15.

Also, the end (lower end) of the arm 24*b*, as shown in FIGS. 13 and 15, is provided with an inclined part 24*u* formed by slantingly cutting an end face thereof so as to have an acute angle (θ) relative to an extending direction (extension line L) of each arm 24*b*.

Figure 16:
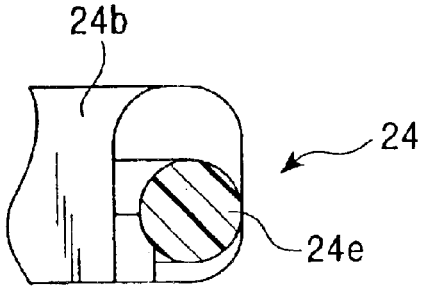
FIG. 16 is a partially enlarged sectional view of the outside lever shown in FIG. 15.
Figure 18:
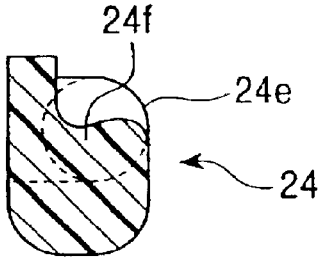
FIG. 18 is a drawing of the outside lever shown in FIG. 17 and viewed in the arrow direction at the line 18—18.

The base-end part 24*a*, as shown in FIG. 16, is provided with a support-receiving part 24*e* formed in the central part of the base-end part 24*a* so as to have a circular cross-section with a small diameter and retainer-receiving parts 24*f* formed in both-ends sides of the base-end part 24*a* so as to have a substantially L-shaped cross-section (see FIG. 18).

Figure 17:
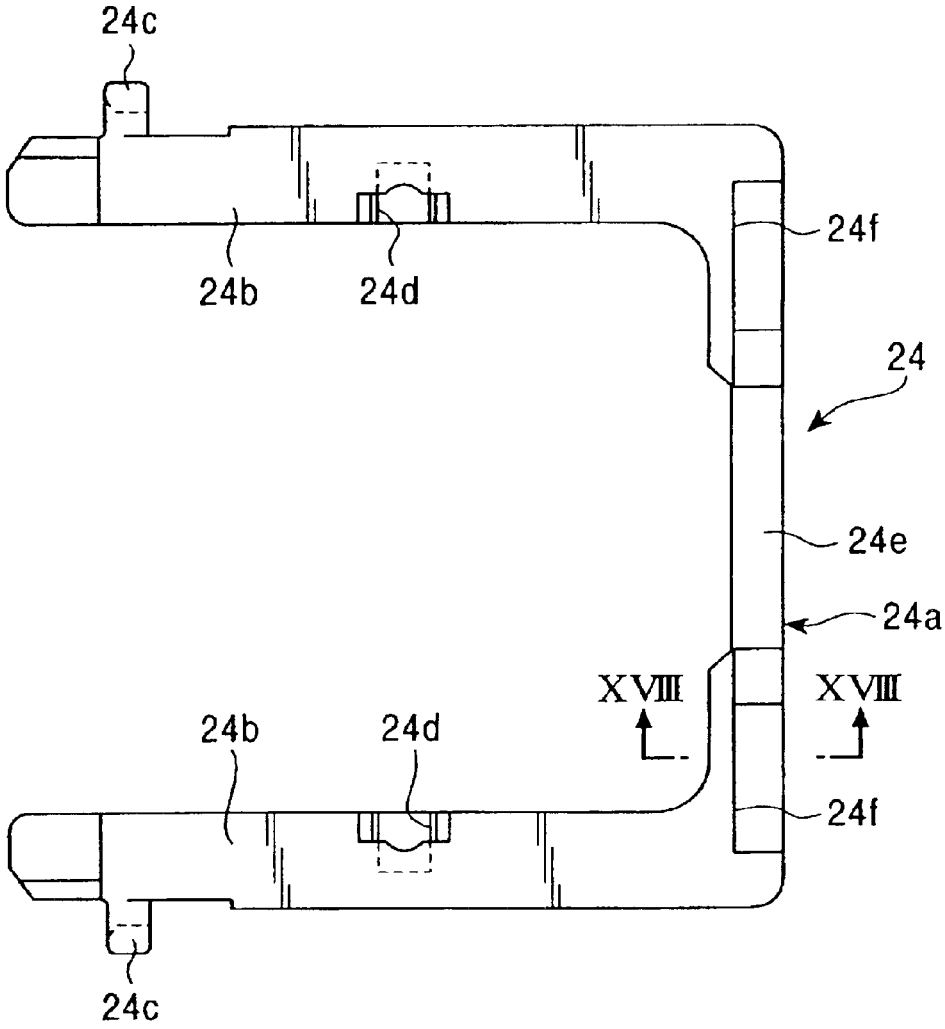
FIG. 17 is a back view of the outside lever shown in FIG. 9.

The pair of second retainers 11*g* of the key-top 11 are tightly mated to the retainer-receiving parts 24*f*. When the retainer-receiving parts 24*f* of the first lever 24 oppose the second retainers 11*g* of the key-top 11, the section of the retaining part thereof is shaped like two commas (see FIG. 18). Engaging slots 24*d* and 24*d* are formed by cuffing-up from the inside so as to oppose each other on internal walls of the arms 24*b* in substantially central parts, as shown in FIG. 17.

Figure 19A:
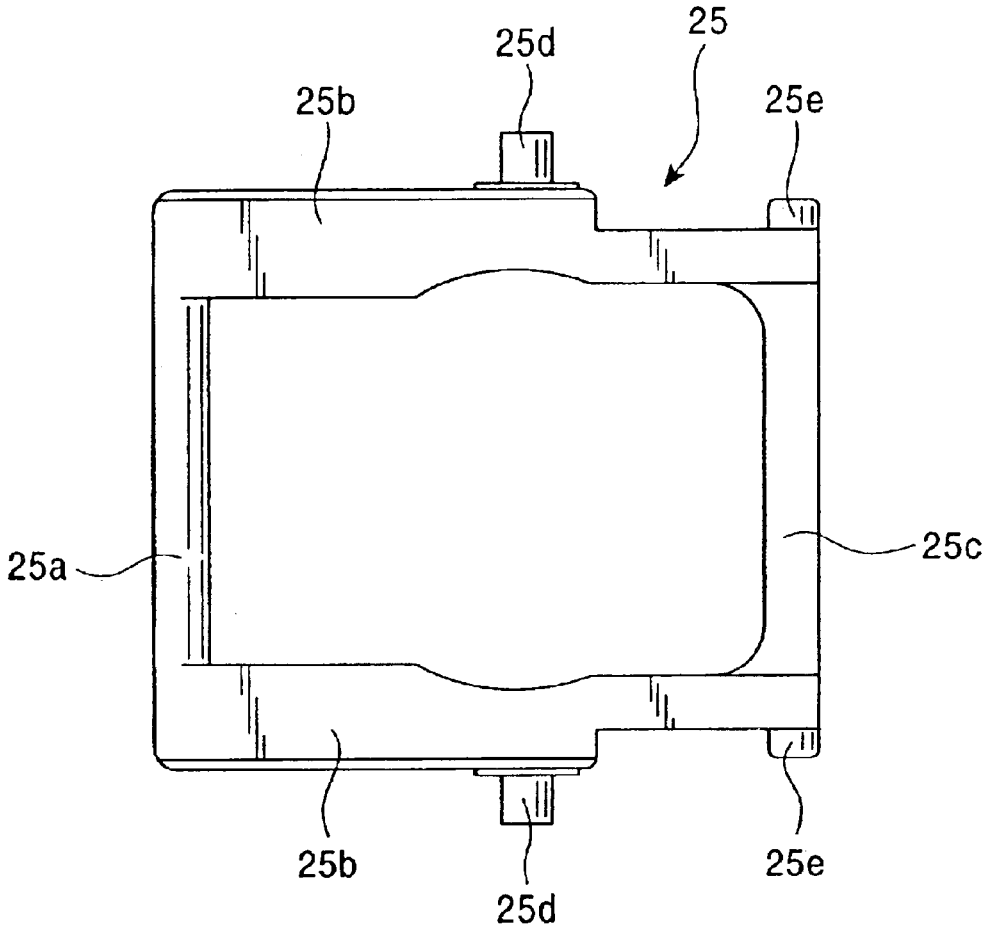
FIG. 19A is a plan view of an inside lever in the key-switch device according to the embodiment of the present invention.
Figure 19B:
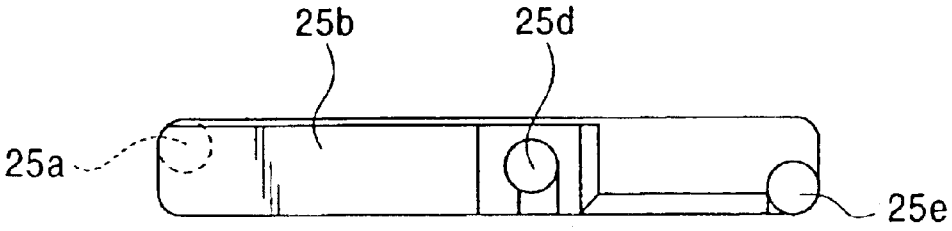
FIG. 19B is a side view of the inside lever.

The second lever (inside lever) 25 made of a rectangular resin-frame having an opening in the center, as shown in FIGS. 19A and 19B, comprises a base-end part 25*a*, a base-shaft part 25*c* arranged in parallel with the base-end part 25*a*, and a pair of arms 25*b* arranged in parallel with each other so as to integrally connect respective both ends of the base-end part 25*a* and the base-shaft part 25*c* together. Or in other words, the pair of arms 25*b* are connected by a connection part, i.e. the base-shaft part 25*c*.

On the substantially central outside wall of each arm 25*b*, an engaging shaft 25*d* is formed to protrude outside.

On the outside wall of each arm 25*b* in the side of the base-shaft part 25*c*, a lower-rotational-retaining projection 25*e* is formed to protrude outside.

The respective engaging shafts 25*d* are brought into engagement with the engaging slots 24*d* of the first lever 24 so as to form an intersecting point S (see FIG. 1), so that the first lever 24 and the second lever 25 are rotatable with each other via the intersecting point S. In addition, the base-shaft part 25*c* is placed as the lower end of the second lever 25.

Figure 20A:
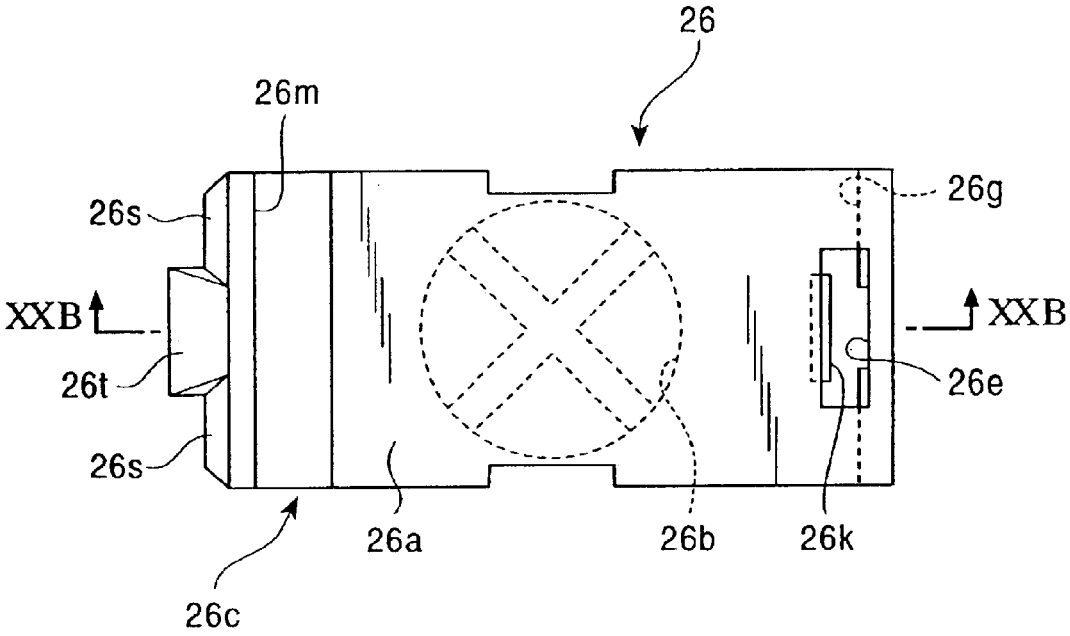
FIG. 20A is a plan view of an actuator member in the key-switch device according to the embodiment of the present invention.
Figure 20B:
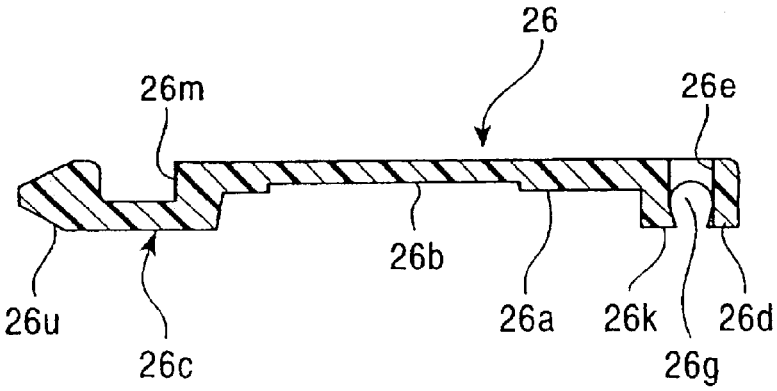
FIG. 20B is a sectional view of the actuator member viewed in the arrow direction at the line 20B—20B.

Then, the actuator member 26 made of a resin, as shown in FIGS. 20A and 20B, comprises a base 26*a* having a substantially rectangular flat-plate shape. The base 26*a* is provided with a rubber-cap abutting part 26*b* formed on the central back surface to have a circular shape with a thinner thickness than other portions of the base 26*a*.

On the back surface of the base 26*a*, a substantially rectangular retaining-projection 26*d* is integrally formed on one end side of the longitudinal direction of the base 26*a* (in the right of FIG. 20A) so as to protrude from the base 26*a*. Also, on the central internal side of the retaining projection 26*d*, a second retaining-projection 26*k* is integrally formed so as to protrude from the back surface of the base 26*a* and to oppose the retaining-projection 26*d*.

The base 26*a* between the retaining-projection 26*d* and second retaining-projection 26*k* is provided with a substantially rectangular retaining-hole 26*e* formed so as to pass through the base 26*a*, and a circular slot 26*g* with a C-shaped cross-section is formed along the retaining-hole 26*e* on one end side of the actuator member 26.

On the base 26*a*, an upper slide-receiving part (slide retainer-receiving part) 26*c* having a substantially U-shaped cross-section is formed on the other end side of the longitudinal direction of the base 26*a* (in the left of FIG. 20A). The upper slide-receiving part 26*c* is provided with a groove 26*m* with an open upper part.

Furthermore, on the central outside end-face of the upper slide-receiving part 26*c* (on the left end-face of FIG. 20A), a retaining projection 26*t* is formed to protrude, and on both sides of the retaining projection 26*t*, retaining-receiving parts 26*s* are respectively formed.

Also, the lower corner of the retaining projection 26*t* of the upper slide-receiving part 26*c* is formed to be an inclined-face part 26*u* by diagonally cutting.

Figure 6:
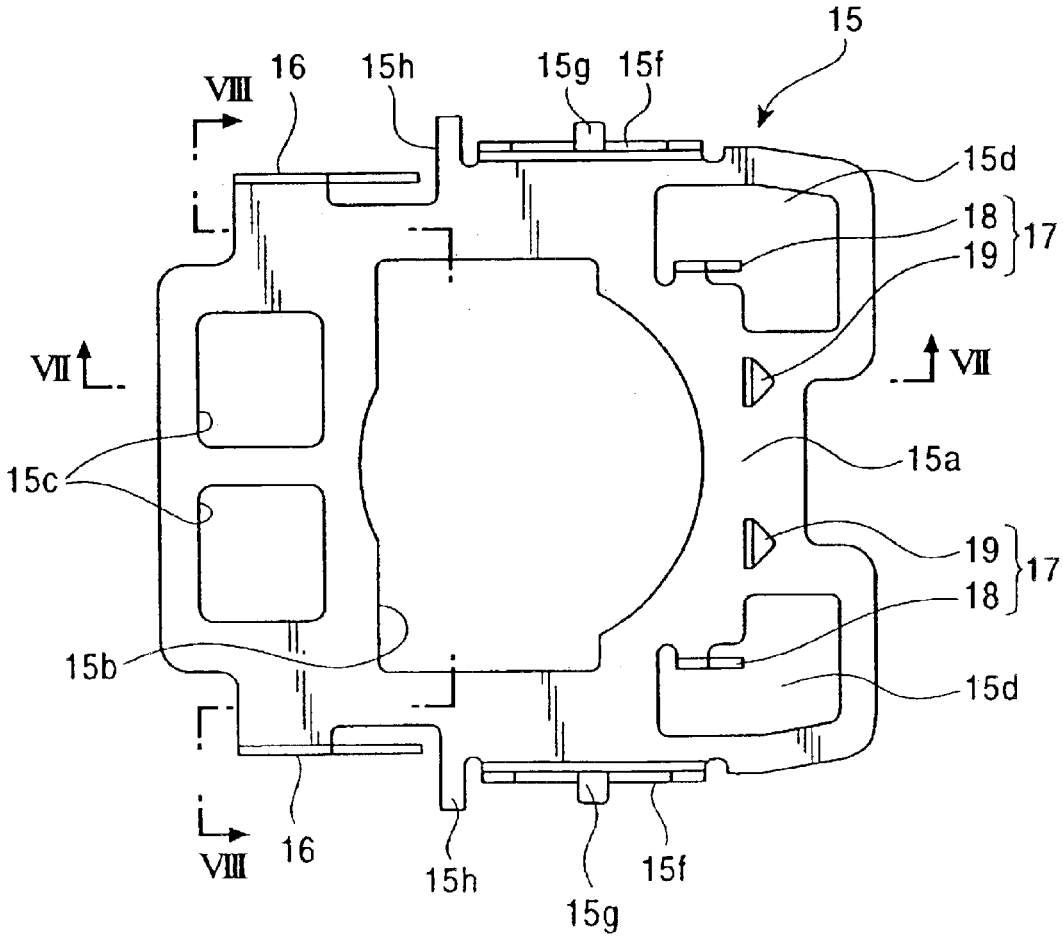
FIG. 6 is a plan view of a lever holding plate in the key-switch device according to the embodiment of the present invention.
Figure 7:
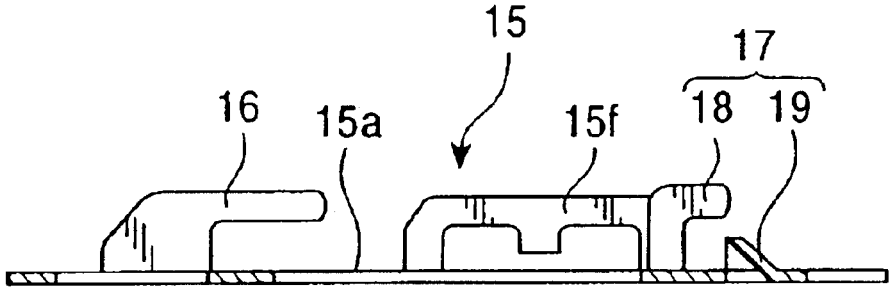
FIG. 7 is a drawing of the lever holding plate shown in FIG. 6 and viewed in the arrow direction at the line 7—7.
Figure 8:
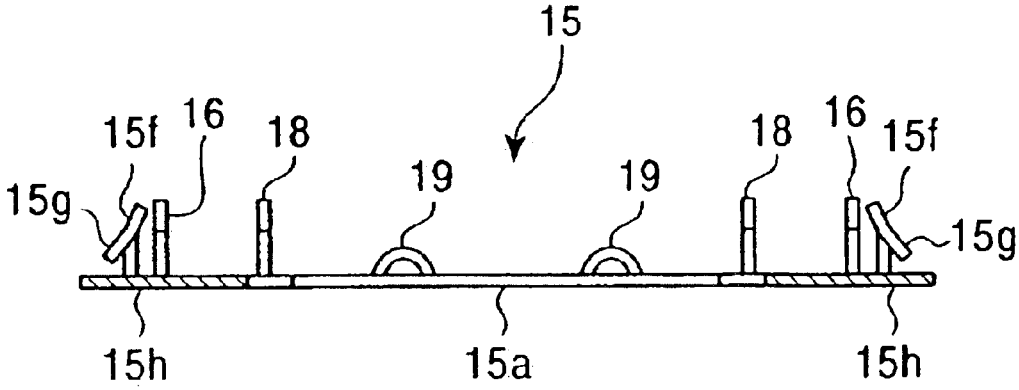
FIG. 8 is a drawing of the lever holding plate shown in FIG. 6 and viewed in the arrow direction at the line 8—8.
Figure 9:
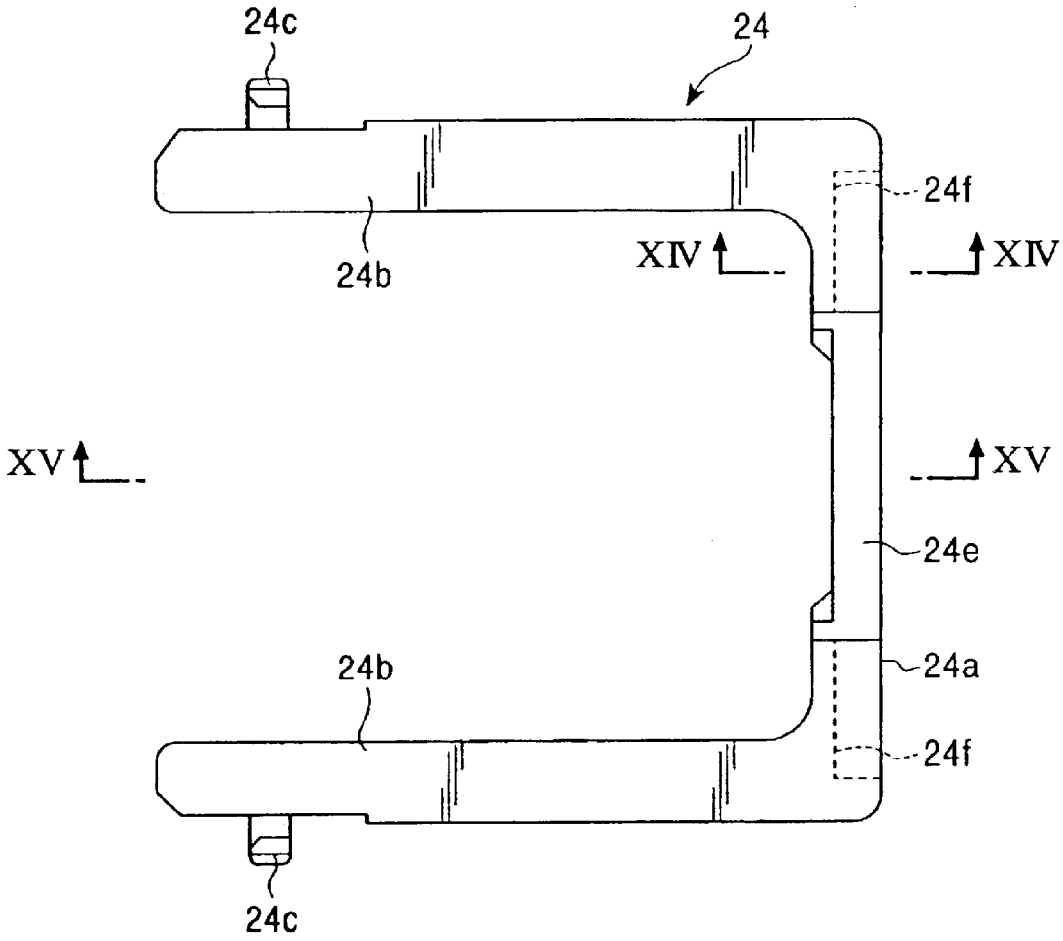
FIG. 9 is a plan view of an outside lever in the key-switch device according to the embodiment of the present invention.
Figure 10:
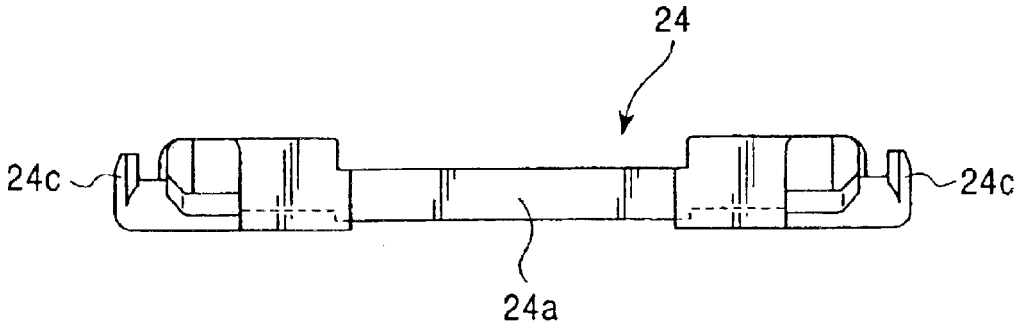
FIG. 10 is a front view of the outside lever shown in FIG. 9.

Next, the lever holding plate 15, as shown in FIGS. 6 to 8, comprises a base 15*a* formed of a substantially rectangular metallic flat plate.

As shown in FIG. 6, the base 15*a* of the lever holding plate 15 is provided with a through-opening 15*b* formed in the central part.

On one end side of the base 15*a* (in the left of the drawing), a pair of first rectangular openings 15*c* are formed close to the through-opening 15*b*, and on the other end side of the base 15*a* (in the right of the drawing), a pair of second substantially rectangular openings 15*d* are formed to have a predetermined space therebetween.

The base 15*a* is further provided with a retainer unit 17 comprising a pair of detachment-preventing retainers (projections) 19 disposed between the pair of second rectangular openings 15*d* and a pair of lower rotational retainers 18 formed to respectively face the internal sides of the second rectangular openings 15*d*.

Specifically, the pair of lower rotational retainers 18 are formed by cutting-up (i.e. cutting and bending) the internal edges of the second rectangular openings 15*d* at a substantially right angle so as to have a substantially L-shape, and the pair of detachment-preventing retainers (projections) 19 are formed by projecting so as to protrude partly from the top surface of the base 15*a* to form fractured planes erected at a substantially right angle on the side of the through-opening 15*b*.

As shown in FIG. 6, the lever holding plate 15 is provided with a pair of lower-slide retainers 16 formed at corners on the sides of the base 15*a* (vertical sides of FIG. 6) by cutting-up (i.e. cutting and bending) the corners of the lever holding plate 15 from the base 15*a* at a substantially right angle so as to have an L-shape.

At side ends of the base 15*a* (ends on vertical sides of the drawing), cut-up parts 15*f* are formed by cutting-up from the base 15*a* at a substantially right angle and arranged to be adjacent to the right in the drawing of the lower-slide retainers 16.

The central part of each cut-up part 15*f* is a cut-slot, in which a tongue piece 15*g* extends downwardly and also slightly protrudes outwardly.

The base 15*a* is further provided with detachment-preventing-protruded pieces 15*h* integrally formed at side ends of the base 15*a* (ends on vertical sides in FIG. 6) and arranged to be adjacent to the cut-up parts 15*f*.

Figure 22:
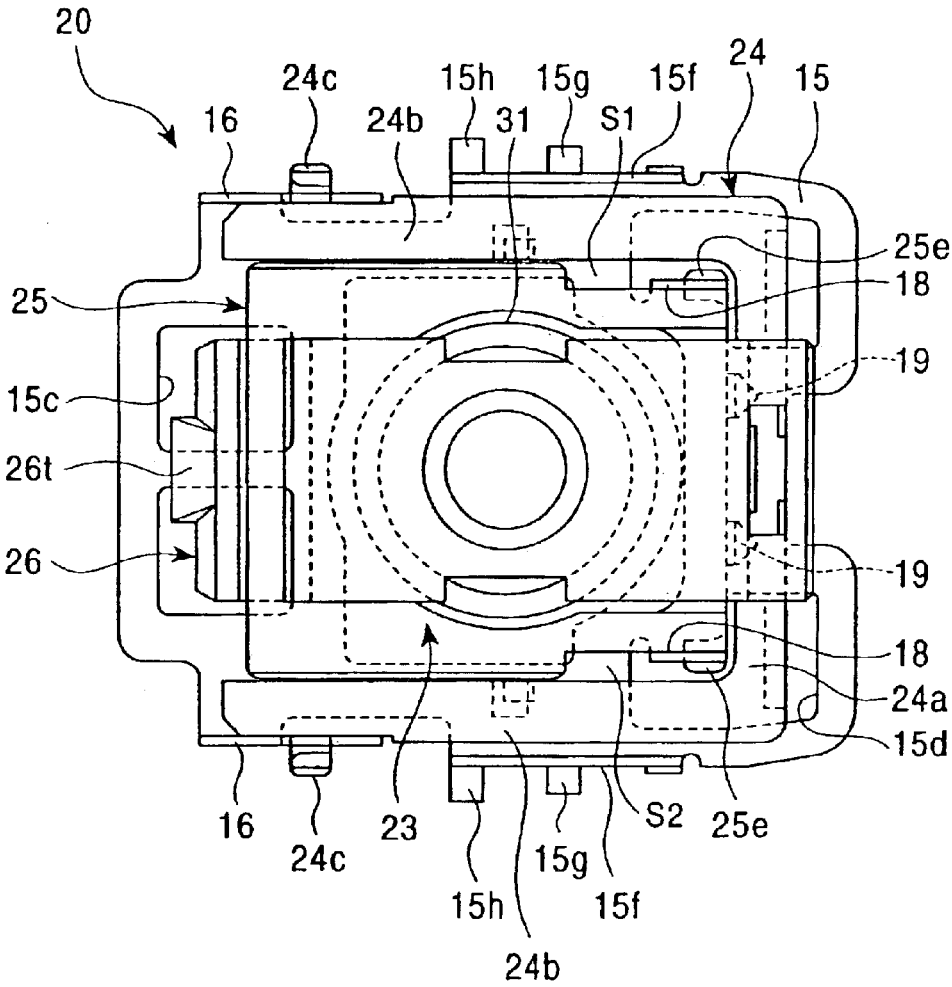
FIG. 22 is a partial plan view of the key-switch device according to the embodiment of the present invention, in which the key-top is removed.

Then, the switch member 30, as shown in FIGS. 1 and 22, is a so-called membrane switch having an elastic rubber cap 31 arranged in the upper part.

The switch member 30 comprises an insulating film sheet 33 and a pair of fixed electrodes (not shown), which are arranged on the film sheet 33 as part of plural switching elements.

The rubber cap 31 is provided with a pressing projection 31*a*, which is formed inside a dome-like ceiling part of the rubber cap 31 so as to protrude downwardly, and a movable electrode 32, which is made of a conductive film and is formed by printing or the like at the end of the pressing projection 31*a* so as to abut the pair of fixed electrodes for switching.

Then, the lower end of the rubber cap 31 is bonded on the film sheet 33 with an adhesive, etc., so that the movable electrode 32 of the pressing projection 31*a* opposes the fixed electrode (not shown).

A rectangular metallic holding plate 37 having plural openings 37*a* is put on top of the lever holding plate 15, and the pair of lower-slide retainers 16, the pair of lower rotational retainers 18, the detachment-preventing retainers (projections) 19, and the link member 20, which are formed on the lever holding plate 15, protrude upwardly from the openings 37*a*.

Under the film sheet 33, a metallic plate 40 is also laid.

Next, an assembling method of the key-switch device configured in such a manner will be described below with reference to FIGS. 21A and 21B to 25.

First, as shown in FIGS. 21A and 21B, the first lever (outside lever) 24 is put on the second lever (inside lever) 25 from the upper part so that each engaging slot 24*d* of the first lever 24 is brought into engagement with each engaging shaft 25*d* of the second lever 25 so as to assemble the lever members 23 which are connected together so as to be rotatable about an intersecting point S.

Continuously, the actuator member 26 is prepared; the side of the retaining projection 26*t* of the actuator member 26 is inserted into the central opening part of the second lever 25 among the first and second levers 24 and 25 forming the lever members 23, while in this state, the base-end 25*a* of the second lever is abutted to the inside the upper slide-receiving part 26*c*. Then, the retaining-projection 26*d* is downward moved to the support-receiving part 24*e* of the first lever 24 so that the slot 26*g* of the retaining-projection 26*d* is snapped and fitted into the support-receiving part 24*e*. In such a manner, the link member 20 is completed.

Figure 23A:
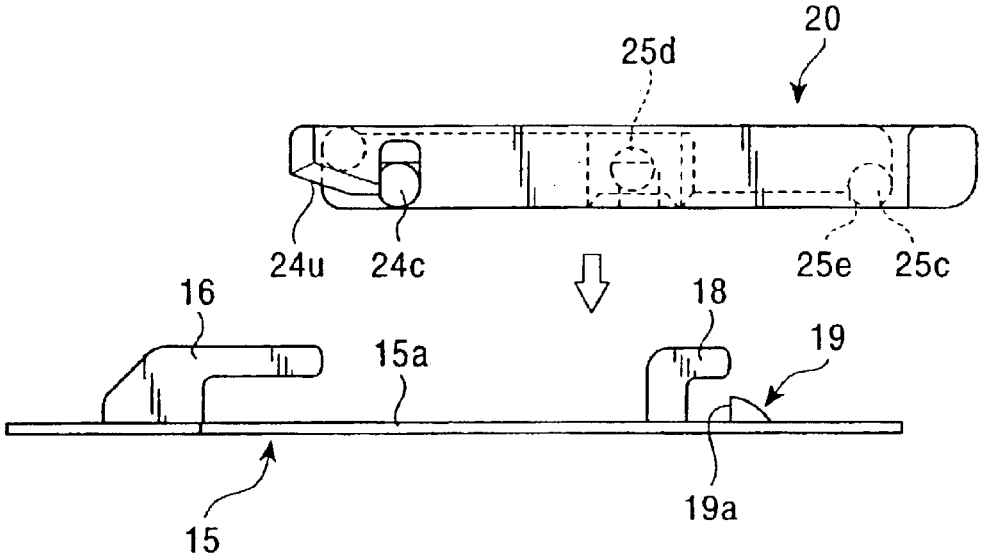
FIGS. 23A, 23B, and 23C are schematic representations for illustrating assembling of the link member in the key-switch device according to the embodiment of the present invention.

Next, as shown in FIG. 23A, the lever holding plate 15 is prepared; the link member 20 is downward inserted on the top surface of the lever holding plate 15. The link member 20 is placed on the top surface of the lever holding plate 15 in a state that the first and second levers 24 and 25 of the link member 20 overlap horizontally.

Figure 23B:
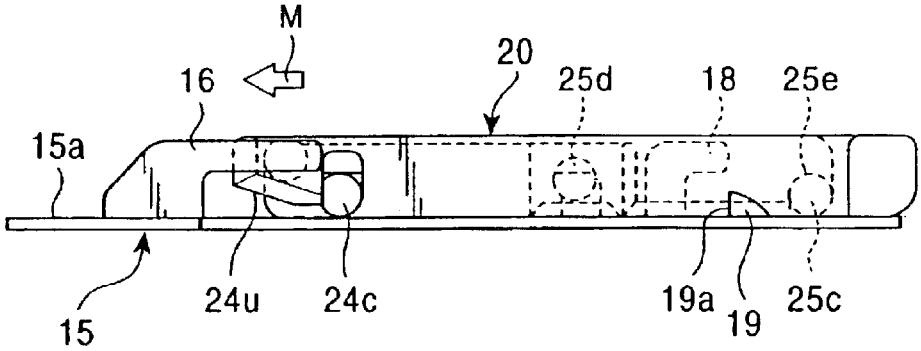
Figure 23C:
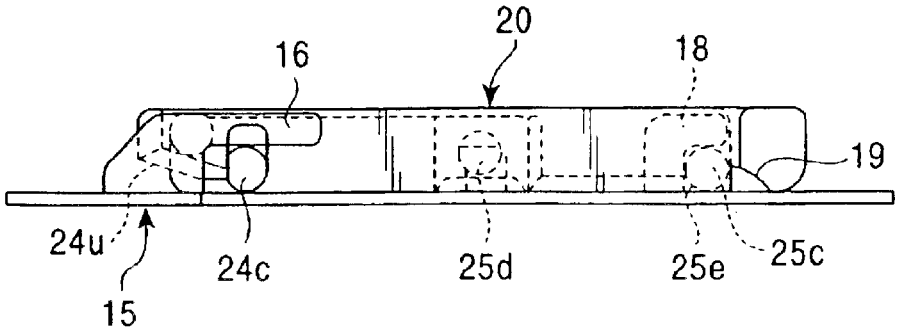

Then, as shown in FIG. 23B, the link member 20 is moved in the M direction of the drawing while sliding the link member 20 in contact with the top surface of the base 15*a* of the lever holding member 15 in the state that the first and second levers 24 and 25 of the link member 20 overlap horizontally. At that, each retaining pin 24*c* of the first lever 24 is slidably brought into engagement with the lower-slide retainer 16.

Figure 24:
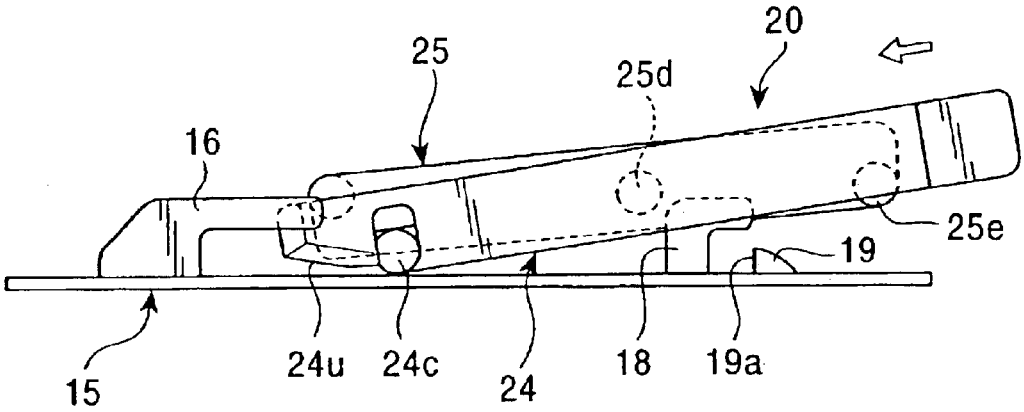
FIG. 24 is a schematic representation for illustrating an example of assembling operation of the link member into the lever holding plate in the key-switch device according to the embodiment of the present invention.
Figure 25:
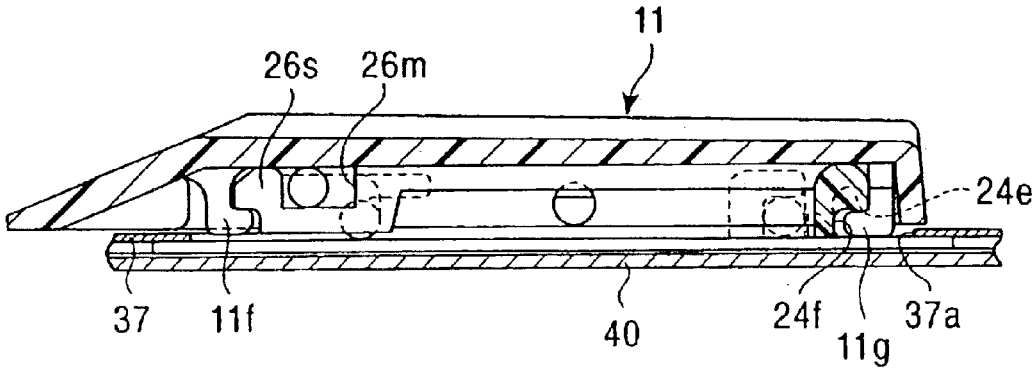
FIG. 25 is a schematic representation for illustrating assembling of the key-top into the link member in the key-switch device according to the embodiment of the present invention.
Figure 26:
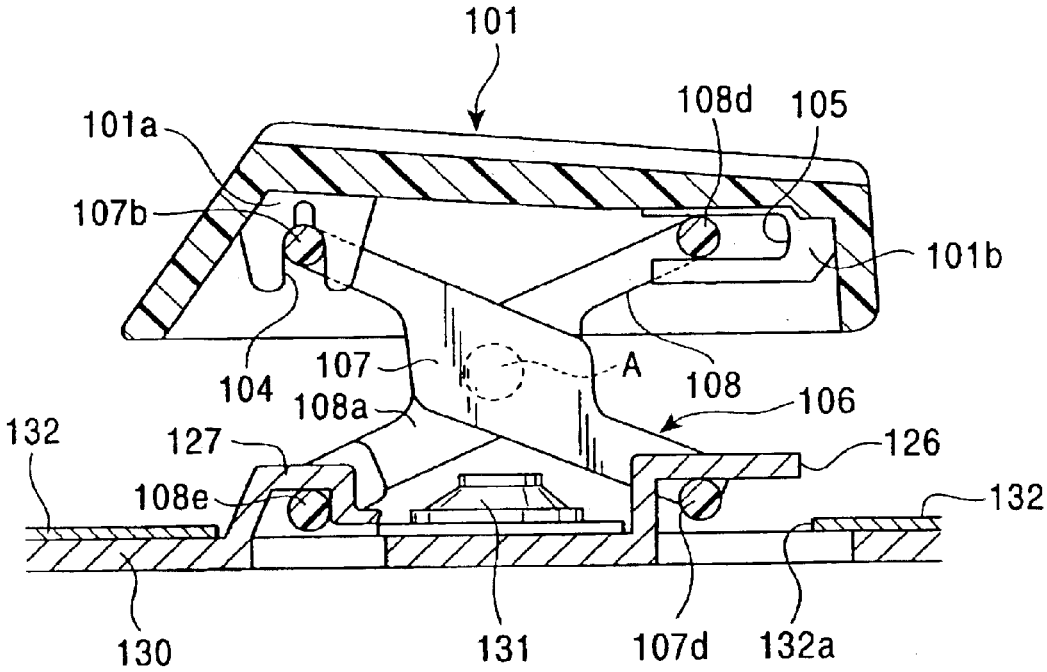
FIG. 26 PRIOR ART
FIG. 26 is a sectional view of a conventional key-switch device.
Figure 27:
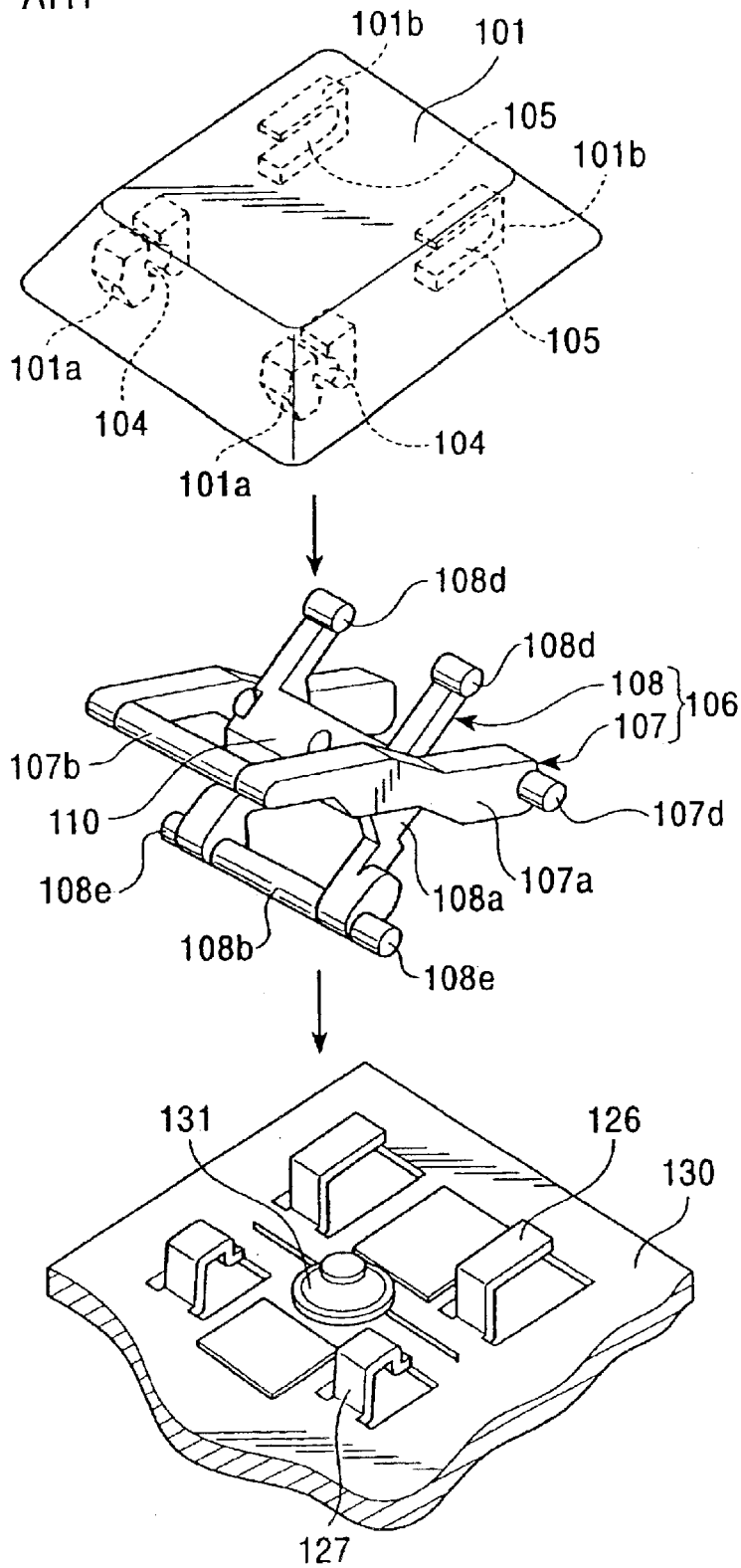
FIG. 27 PRIOR ART
FIG. 27 is an assembly view of the conventional key-switch device.
Figure 28:
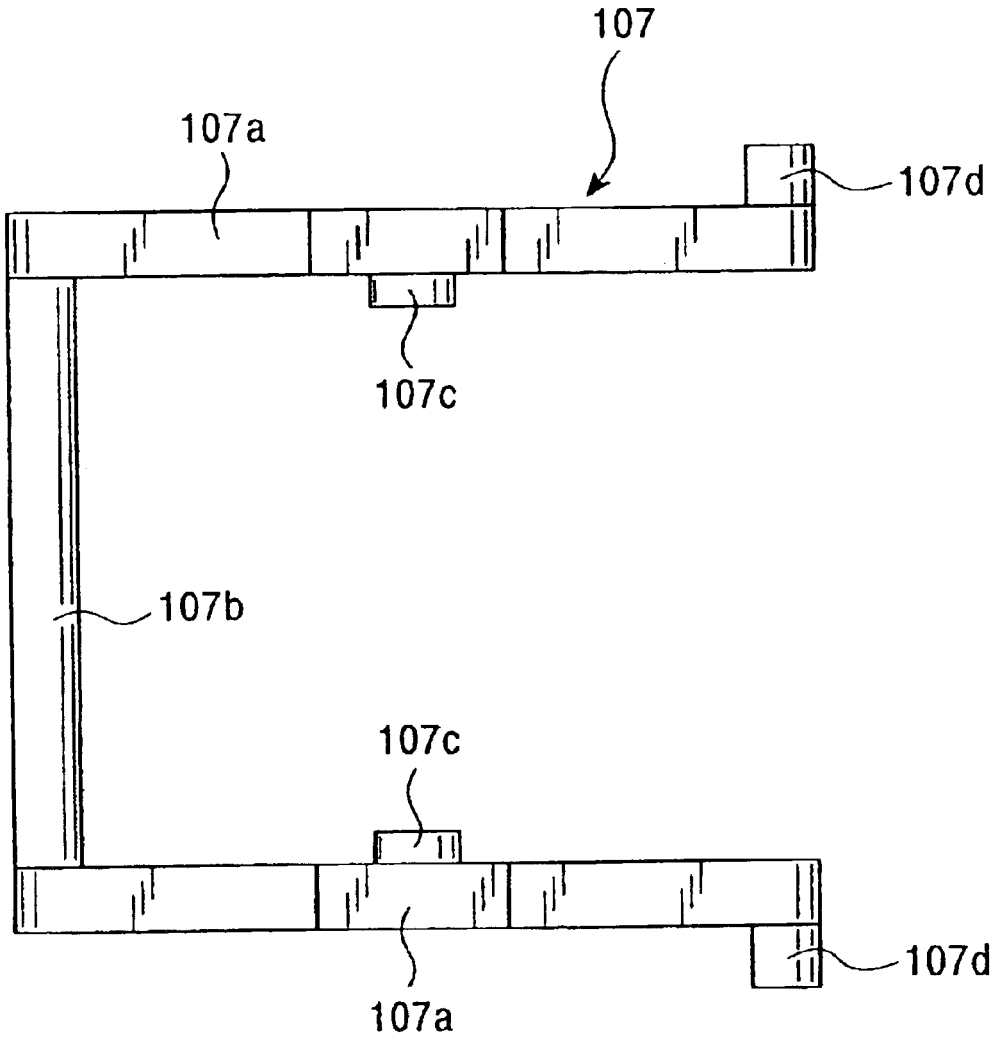
FIG. 28 PRIOR ART
FIG. 28 is a plan view of one link member for use in the conventional key-switch device.
Figure 29:
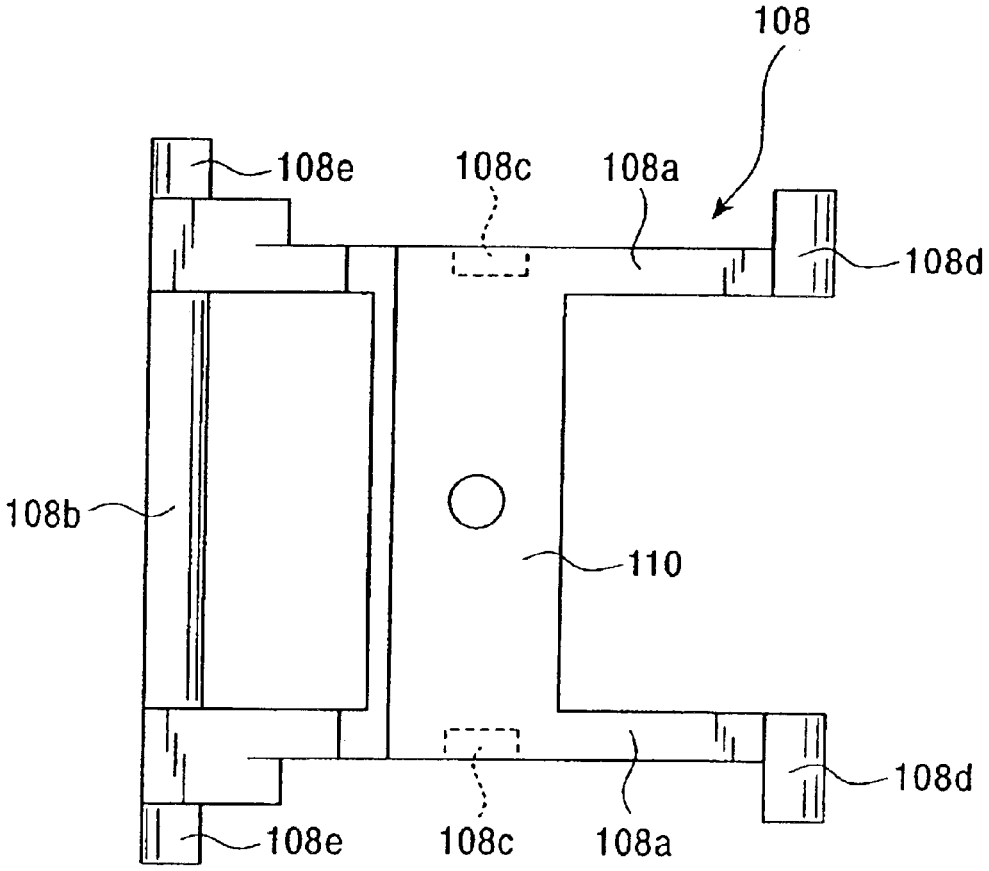
FIG. 29 PRIOR ART
FIG. 29 is a plan view of the other link member for use in the conventional key-switch device.

In addition, even when the link member 20 is oblique relative to the top surface of the base 15*a* of the lever holding member 15, as shown in FIG. 24, or even when the retaining pin 24*c* is directly inserted into the lower-slide retainer 16 obliquely from the rear (upper right in FIG. 23A), the link member 20 can be smoothly inserted without any resistance by inserting it along the inclined part 24*u* of the first lever 24.

Since the upper slide-receiving part 26*c*, which is the free end of the actuator member 26, is rotatably journaled by the support-receiving part 24*e* of the first lever 24 via the circular slot 26*g*, the inclined-face part 26*u* slides on the top surface of the base 15*a* of the lever holding plate 15 during the assembling. At this time, the link member 20 is smoothly inserted due to oblique chamfering.

The base-shaft part 25*c* of the second lever 25 gets over the pair of detachment-preventing retainers 19 of the lever holding plate 15 while sliding in contact with them so as to be positioned in the clamped state between the lower rotational retainers 18 and the fractured planes of the detachment-preventing retainers 19, while the lower-rotational-retaining projections 25*e* are brought into the lower rotational retainers 18.

In such a manner, the lower ends of the first and second levers of the link member 20 are attached on the lever holding plate 15.

Next, the lever holding plate 15 having the link member 20 attached thereto is upward inserted toward the openings 37*a* of the holding plate 37 and is brought into engagement therewith by snapping-in the cut-up parts 15*f* of the lever holding member 15.

Continuously, the film sheet 33 having the rubber cap 31 bonded to the lower end thereof with an adhesive in advance is arranged under the holding plate 37. Then, the film sheet 33 is put on the holding plate 37 while the rubber-cap abutting part 26*b* of the actuator member 26 abuts the top of the rubber cap 31, and the metallic plate 40 is further put under the film sheet 33 (see FIG. 22).

Next, the key-top 11 is prepared: the key-top 11 is downward put on the link member 20, which is exposed from the openings 37*a* of the holding plate 37.

At this time, to the link member 20, which is at the elevated position due to the elastic force of the rubber cap 31 as shown in FIG. 1, the key-top 11 is downward pressed using the pair of first ribs 11*j* and the second rib 11*h* as guides during inserting the key-top 11. Then, as shown in FIG. 3, the retaining projection 26*t* of the actuator member 26 is fitted between the first retainers 11*f*, so that the first retainers 11*f* of the key-top 11 are snapped in the retaining-receiving parts 26*s*, while the retaining-projection 26*d* of the actuator member 26 is arranged between the second retainers 11*g*, so that the second retainers 11*g* of the key-top 11 are snapped in the retainer-receiving parts 24*f* (see FIGS. 2 and 3).

Then, the rubber cap 31 recovers due to the elastic force thereof so that the link member 20 is elevated. According to the elevation, the sliding contact part 24*c*1 of the retaining pin 24*c* of the first lever 24 securely slides within the lower-slide retainer 16 while being guided by the end part 24*c*2, thereby completing the key-switch device shown in FIG. 1.

The embodiment according to the present invention has been described; however, the present invention is not limited the embodiment described above, and modifications may be made within the spirit and scope of the invention.

The key-switch device according to the embodiment configured and assembled as described above has the advantages as follows:

1) The actuator member 26 has the slide-receiving part 26*c* formed therein having the groove 26*m* with an open upper part, and the base-end part 25*a* of the second lever 25 is slidably retained to the slide-receiving part 26*c*, so that the key-top 11 can be readily installed while maintaining a predetermined intersecting angle between the first and second levers 24 and 25 due to the actuator member 26.

2) The base-end part 24*a* of the first lever 24 has the support-receiving part 24*e* at the center for retaining one end of the actuator member 26 while the retainer-receiving parts 24*f* for retaining the second retainers 11*g* of the key-top 11 are formed on both sides of the support-receiving part 24*e*, so that the second retainers 11*g* and the retainer-receiving parts 24*f* are opposed and retained to each other. This portion is formed to have a patterned section shaped like two-commas, so that even when an external force is accidentally applied to the key-top 11, the key-top 11 can be securely held not to simply come off the link member 20.

3) The retainer of the key-top 11 comprises a pair of first retainers 11*f* and a pair of second retainers 11*g*, which are formed on the back surface 11*d* so as to protrude therefrom, and the back surface 11*d* of the key-top 11 is provided with a pair of first ribs 11*j*. The first ribs 11*j* protrude from the back surface 11*d* in the vicinity of the exterior of the second retainers 11*g*, i.e. more distal to the center of the lateral side on which the first ribs 11*j* and the second retainers are formed. The second rib 11*h* extends in parallel with the first ribs 11*j* in the vicinity of the first retainers 11*f*, without extending to a position between the first retainers 11*f*. The key-top 11 is then mounted by respectively guiding the pair of arms 24*b* of the first lever 24 and the other end of the actuator member 26 with the first ribs 11*j* and the second rib 11*h*. Thereby, the key-top 11 can be simply and securely mounted by using the first ribs 11*j* and the second rib 11*h* as guides without mounting by guessing roughly as in a conventional device.

4) The base-end part 24*a* of the first lever 24 is journaled on bearings by the one end of the actuator member 26, and the lower corner of the other end of the actuator member 26 is obliquely cut with respect to a lower surface of the actuator member 26, so that the actuator member 26 can be smoothly assembled while sliding it in contact with the top surface of the base 15*a* of the lever holding plate 15.

5) The retaining section of the lever-holding plate 15 comprises a lower-slide retainer 16 for slidably retaining the lower end of the first lever 24 and a retainer unit 17 for rotatably journaling the lower end of the second lever 25 on bearings, and the lower end of the first lever 24 is provided with a retaining pin 24*c*, which is a detachment preventing part formed for preventing the lower end of the first lever 24, so that when the key-top 11 is pressed to operate, even when the sliding first lever 24 deflects due to defects in the resin or changes caused by the passage of time, predetermined operation can be securely performed without detachment.

6) At the lower end of the first lever 24, the end face sliding on the top surface of the base 15*a* of the lever-holding plate 15 is obliquely cut so as to have an acute angle relative to the extending direction of each of the arms 24*b*, so that the lower end of the first lever 24 can be smoothly assembled while sliding the first lever 24 in contact with the top surface of the base 15*a* of the lever holding plate 15.

What is claimed is:

1. A key-switch device comprising:

a key-top having retainers formed on a back surface of the key-top;

first and second levers disposed under the key-top, each lever including a base-end part and a pair of arms opposing each other and extending from both ends of the base-end part, the first and second levers being connected together rotatably about a substantial center of the pair of arms as an intersecting point;

a lever-holding plate to retain each lower end of the first and second levers; and an actuator member attached to and spanned between both the base-end parts of the first and second levers;

wherein the actuator member has a slide-retainer-receiving groove with an open upper part and a journal-retainer-receiving slot with an open lower part, the journal-retainer-receiving slot having a circular slot and an opposing retaining protection, and wherein the base-end part of the second lever is slidably retained in the slide-retainer-receiving groove.

2. The key switch device according to claim 1, wherein the slide-retainer-receiving groove is at a first end of the actuator member, the journal-retainer-receiving slot is at a second end of the actuator and the base-end of the first lever is journally mounted in the journal-retainer-receiving slot.

3. The key switch device according to claim 1, further comprising a switch member being switchably operable in accordance with up-and-down movement of the key top.

* * * * *